US007276205B2

(12) United States Patent
Willoughby et al.

(10) Patent No.: US 7,276,205 B2
(45) Date of Patent: Oct. 2, 2007

(54) INJECTION DEVICE AND PROCESS FOR THE INJECTION OF A FLUID

(75) Inventors: Craig Willoughby, Sheffield (GB); Cavan Millward, Chesterfield (GB)

(73) Assignee: Vesuvius Crucible Company, Wilmington, DE (US)

( * ) Notice: Subject to any disclaimer, the term of this patent is extended or adjusted under 35 U.S.C. 154(b) by 546 days.

(21) Appl. No.: 10/516,999

(22) PCT Filed: Jun. 3, 2003

(86) PCT No.: PCT/BE03/00097

§ 371 (c)(1),
(2), (4) Date: Dec. 3, 2004

(87) PCT Pub. No.: WO03/103877

PCT Pub. Date: Dec. 18, 2003

(65) Prior Publication Data

US 2005/0218568 A1 Oct. 6, 2005

(30) Foreign Application Priority Data

Jun. 7, 2002 (EP) ..... 02447113

(51) Int. Cl.
*C21C 5/48* (2006.01)

(52) U.S. Cl. ..... 266/265; 266/218; 266/186

(58) Field of Classification Search ..... 266/265, 266/218, 224, 186
See application file for complete search history.

(56) References Cited

U.S. PATENT DOCUMENTS 4,725,047 A * 2/1988 LaBate ..... 266/270
4,938,461 A * 7/1990 Bertollo ..... 266/266
5,104,097 A * 4/1992 Naujokat et al. ..... 266/217
5,265,850 A * 11/1993 Aramaki et al. ..... 266/220
5,330,160 A * 7/1994 Eisermann et al. ..... 266/44
5,421,561 A * 6/1995 Eisermann et al. ..... 266/100
5,478,053 A * 12/1995 Richter et al. ..... 266/89
5,573,724 A 11/1996 Soofi

FOREIGN PATENT DOCUMENTS

| | | |
|---|---|---|
| EP | 0 290 766 | 6/1990 |
| EP | 10101 825 B1 | 5/2001 |
| JP | 60-046312 A | 3/1985 |
| JP | 2002-129244 A | 5/2002 |

* cited by examiner

*Primary Examiner*—Len Tran
(74) *Attorney, Agent, or Firm*—James R. Williams

(57) ABSTRACT

The invention relates to an injection device for the reliable introduction of a fluid into a metallurgical vessel having a refractory lining, the device being removably insertable in the lining; comprising a refractory first body (2) and a refractory second body (3) fittingly assembled, the first body (2) being made of a refractory material less permeable to the fluid than the material of the second body (3), the first and second bodies having each a surface (4, 5) adapted to contact molten metal; and having each fluid passages (6, 7) extending from fluid feeding means (8) to a surface (4, 5) adapted to contact molten metal, the relative flow resistance of the fluid passages (7) in the second body (4) being higher than that of the fluid passages (6) in the first body (2), the fluid passages (6) in the first body (2) being constituted of slots or bores. According to the invention, the fluid passages (6) in the first body (2) are independent from the fluid passages (7) in the second body (3). Such an injection device permits the reliable introduction of a fluid into a metallurgical vessel even when the injection device has already been used.

9 Claims, 1 Drawing Sheet

INJECTION DEVICE AND PROCESS FOR THE INJECTION OF A FLUID

The present invention relates to injection devices for the introduction of a fluid into a metallurgical vessel and to a process for the injection of a fluid. In particular, the invention relates to such a device which is removably insertable in the lining of a metallurgical vessel.

Fluids, in particular gases, are often injected into molten metal in vessels such as ladles, crucibles or tundishes for diverse purposes. For instance, a gas may be introduced into the bottom part of a vessel to clear the relatively cool bottom area of solidification products, e.g. to remove them from the vicinity of a bottom pour outlet where the vessel has such an outlet. In steel making for example, the use of slow injection of a fine curtain of gas bubbles in the tundish assists in inclusion removal; the inclusions being attracted to the fine gas bubbles and rising upwards through the melt to the surface where they are conventionally captured by the tundish cover powder or flux. A fluid may also be introduced for rinsing or to homogenise the melt thermally or compositionally, or to assist in dispersing alloying additions throughout the melt.

Usually, an inert fluid is used but reactive fluids may also be employed, e.g. reducing or oxidising gases, when the melt compositions or components thereof needs modifying. For example, it is customary to inject gases such as nitrogen, chlorine, freon, sulphur hexafluoride, argon, and the like into molten metal, for example molten aluminium or aluminium alloys, in order to remove undesirable constituents such as hydrogen gas, non-metallic inclusions and alkali metals. The reactive gases added to the molten metal chemically react with the undesired constituents to convert them into a form such as a precipitate, a dross or an insoluble gas compound that can be readily separated from the remainder of the melt. These fluids (or others) might also be used for example with steel, copper, iron, magnesium or alloys thereof.

Because of varied operational requirements, two different types of injection devices are employed:

porous purging plugs, where the fluid streams through irregularly distributed and variously sized pores and plugs where the fluid flow direction and also the size of the openings, through which the fluid is piped, are controlled. These openings can be round canals or bores, which are either kept separate or interlinked or slots which, when segments are assembled, can be arranged in a straight line, or in a circle, by fitting two cone stumps together.

In order to achieve optimal cleaning, it is desirable that the fluid be introduced into the molten metal, preferably from the bottom of the recipient, in the form of a very large number of extremely small bubbles so as to quickly transport the non-metallic impurities or gases into the slag. As the size of gas bubbles decreases, the number of bubbles per unit volume increases. An Increase in the number of bubbles and their surface area per unit volume Increases the probability of the injected gas being utilised effectively to perform the expected cleaning or rinsing operation. The best injection devices to achieve this cleaning or rinsing operation are therefore porous plugs.

Where homogenisation is necessary (i.e., where additives have to be distributed and dissolved) or a temperature balance has to be achieved, purging plugs are used to assist mixing by blowing large amounts of gas into the metal bath. For these applications, purge plugs with directed porosity have proved to be the most effective alternative.

Generally, the choice of the injection device type will thus depend on the main requirements of a specific application.

As starting point for the present application, the inventors had in mind to improve the reliability of the injection devices of the type "purge plugs with directed porosity". It is indeed generally considered that a constant flow of fluid through the directed porosity is necessary in order to prevent blockage by the ingress of molten metal. The need to shut-off the fluid supply at the end of each injection operation would therefore result in blockage and would tend to make difficult, if not impossible, the re-use of the injection device, especially if the available fluid pressure is not sufficient to re-open the fluid passages. Generally, it is considered that below 10 bars there is a risk that injection devices of the type "purge plugs with directed porosity" could not open. To avoid that problem, Japanese patent application (Kokai) 60-46312 for example teaches to only use mass porosity to assist mixing.

European patent 424,502 already addresses this problem and proposes a gas injector with gas passages formed as capillary bores or slots in a rod constituted of a gas impermeable refractory material. The capillary bores or slots are of such a small dimension that, in use, the molten metal is substantially unable to intrude into the passages.

Although this injection device already constitutes a great step forward in the reliability of fluid injection into a metallurgical vessel, it is desirable to find alternative injection devices. Ideally, such injection device should at least equal the reliability of the gas injector disclosed in the European patent 424,402 and be produced economically and simply through conventional techniques and with conventional materials. It should also be possible to open this injection device even when the maximum available fluid pressure is relatively low (for example lower than 10 bars).

The German patent application DE-A1-1,101,825 discloses an injection device for the introduction of a fluid into a metallurgical vessel having a refractory lining, the device being removably insertable in the lining;

comprising a refractory first body and a refractory second body fittingly assembled, the first and second bodies having each a surface adapted to contact molten metal; and having fluid passages extending from fluid feeding means to a surface adapted to contact molten metal and comprising fluid passages in the first body and in the second body, the relative flow resistance of the fluid passages of the second body being higher than that of the fluid passages of the first body.

According to the invention, the fluid passages in the first body are independent from the fluid passages in the second body. It has indeed been observed that when the directed porosity of the first body is interlinked with the fluid passages of the second body as disclosed in DE-A1-1,101,825—for example when slots of the first body are directly adjacent to the second body—this could result in the separation of the bodies. In particular, when one of the bodies is inserted In another body, this results in a blow out of the surrounded body.

According to the invention, the fluid passages of the first body—which have thus generally wider openings—are more prone to blockage after shut-off of the fluid supply. When the fluid pressure is applied to the injection device, the fluid will therefore be first introduced into the molten metal through the second body if the injection device has already been used and some metal remains on its surface blocking the fluid passages of the first body. As the pressure increases progressively, the flow rate through the second body increases until the fluid plume will begin to impact on the molten metal contact surface of the first body through a phenomenon of back attack fluid flow which causes molten metal agitation.

Eventually, this attack of the molten metal contact surface of the first body will result in the clearance and opening of the first body fluid passages. The relative flow resistance of the fluid passages of the second body being higher than that of the fluid passages of the first body, the fluid will tend to follow the path of least resistance and therefore will flow through the fluid passages of the first body while the second body will substantially cease to allow fluid passage. This will allow a higher flow rate to pass within the molten metal, with all the above listed advantages of the purge plug with directed porosity.

Preferably, the fluid feeding means for the fluid passages of the first and second bodies are common.

According to a preferred embodiment of the invention, the fluid passages of the first and second bodies are formed differently so that the relative flow resistances of these fluid passages can be appropriately controlled. Advantageously, the second body is constituted of a fluid permeable refractory material, i.e. a material which is porous to the said fluid In the conditions of use. Advantageously, the second body is made of a pressed refractory material whose granulometry is defined so as to achieve the desired porosity.

The inventors have indeed observed that the second body made of a refractory material which is permeable to the fluid to inject is far less sensitive to molten metal penetration than the fluid passages in the first body and that, consequently, during initial flowing of the fluid, the fluid passages constituted by the porous arrangement of the second body clears and opens more readily than the fluid passages in the first body. In other words, a lower pressure is necessary to clear and open the fluid passages in the second body.

A further advantage which has been unexpectedly observed with this preferred embodiment is the following: when the metal penetration in the fluid passages of the first body is too severe so that these fluid passages fail to open directly under the effect of the back attack fluid flow streaming from the fluid permeable second body, then, for a certain time, all the fluid is injected through the second body. This results in the surface of the second body wearing to some extent. When the second body has worn back to below the level of the surface of the first body. This results in turn to a surface layer of the first body above the remaining surface of the second body becoming weaker and breaking away easier. Eventually, the blocked surface of the first body having broken away, the fluid passages of the first body are cleared and can now open easily. It is believed that this results from the fact that a fluid permeable refractory material is more prone to wear.

Numerous arrangements of the first and second bodies in the injection device can be considered. For example, the second body can be formed as an annular porous ring surrounding a first body comprising slots formed in a fluid-impermeable material. However, the above discussed advantage is particularly noticeable when the second body is fittingly inserted in the first body, preferably in the middle of the first body so that the wear pattern of the molten metal contacting surface of the injection device is more even across this surface. In an advantageous embodiment of the invention, the fluid passages in the first body are aligned radially from the centre point of the second body so that all the fluid passages of the first body will be affected equally by the surface wear resulting from the fluid streaming from the second body. Nevertheless, for constructional and economical reasons, it can be advantageous to maximize the dimension of the second body. Therefore, the invention also relates to an injection device wherein the fluid passages in the first body are arranged substantially parallel to the interface between the first and second bodies so that the second body can occupy more space. The second body can have a round or polygonal section.

In a preferred variant of the invention, the first body is made of a refractory material less permeable to the fluid than the material of the second body, for example of a castable material, and the fluid passages extending therethrough are constituted of slots or bores, preferably of controlled direction and opening sizes.

In another of its aspects, the invention relates to a process for the reliable injection of a fluid into a metallurgical vessel comprising the steps of a) feeding an injection device with the fluid to introduce into the metallurgical vessel;

b) injecting the said fluid through a initiating section of the injection device having higher fluid flow resistance than the remainder of the injection device (the initiating section being able to open more easily than the remaining sections of the injection device);

c) using the fluid flow streaming from the said initiating section for cleaning and opening fluid passages in an injection section of the injection device having less fluid flow resistance than the initiating section;

d) injecting the fluid into the metallurgical vessel through the injection section while the initiating section substantially ceases to allow fluid passage.

The invention will now be better described with reference to the enclosed drawings which are only provided for the purpose of illustrating the invention and not to limit its scope.

FIG. 3 is a top view of a variant of the injection device.

Figure 2:
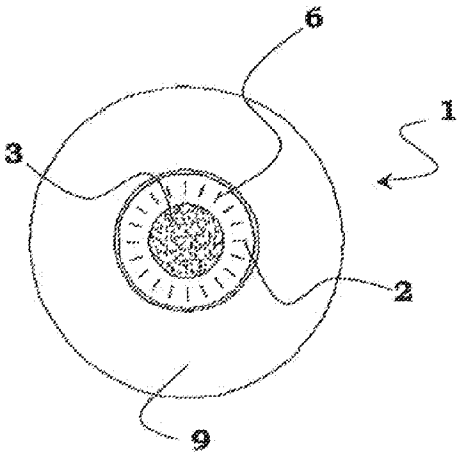
FIG. 1 shows schematically an injection device according to the invention and FIG. 2 is a top view of the injection device shown at FIG. 1.
Figure 1:
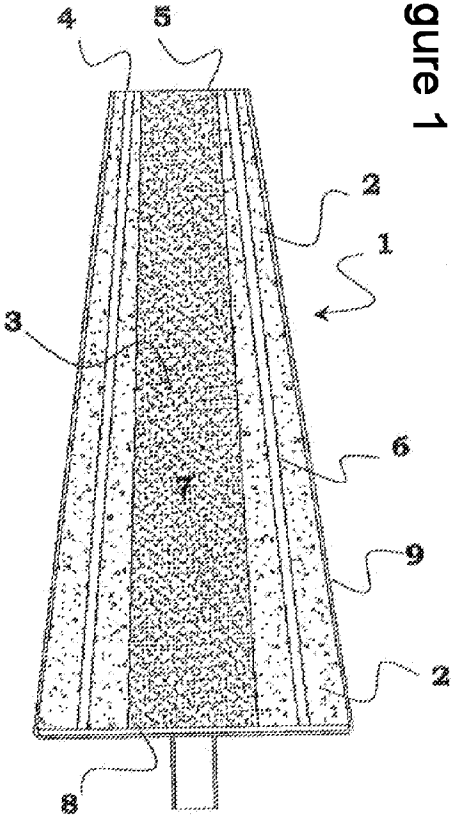

In these figures, the injection device (1) is inserted into the lining of a metallurgical vessel (not shown) with its molten metal contacting surfaces (4, 5) at least level with the surface of the lining. The injection device is comprised of at least first and second bodies (2, 3) which are fittingly assembled. Most often the injection device is enveloped in a metal can (9). The first body (2) comprises fluid passages (6)—constituted by slots—extending from fluid supply means (8) to its molten metal contacting surface (4). The second body (3) comprises fluid passages (7)—constituted by the porosity of the material—extending from its molten metal contacting surface (5) to fluid supply means (8). In the embodiment of FIG. 2, the fluid passages 6 extend radially from a centre point of the second body. In the embodiment of FIG. 3, the fluid passages 6 are arranged substantially parallel to the interface between the first and second bodies (2, 3). In the embodiment depicted on FIGS. 1 to 3, the fluid supply means (8) are constituted by a plenum chamber which is connected to a fluid feeding pipe (not shown).

It has been observed that a fluid pressure of 6 to 9 bars is sufficient to open the fluid passages of the injection device according to the invention.

The invention claimed is:

1. Injection device for the introduction of a fluid into a metallurgical vessel having a refractory lining, the device being removably insertable in the lining and including a refractory first body comprising a refractory first material fittingly assembled to a refractory second body comprising a refractory second material, the first material less permeable to the fluid than the second material, the first and second bodies each comprising a contact surface adapted to contact molten metal and a plurality of fluid passages extending from a fluid feeder to the contact surface, the fluid passages of the second body having a higher relative flow resistance than the fluid passages of the first body, the fluid passages of the first body being independent from the fluid passages of the second body, and the fluid passages of the first body comprising at least one geometry selected from the group consisting of slots and bores.

2. The injection device of claim 1, wherein the second body is fittingly inserted into the first body.

3. The injection device of claim 2, wherein the second body is inserted into a middle of the first body.

4. The injection device of claim 3, wherein the fluid passages of the first body are substantially parallel to an interface between the first and second bodies.

5. The injection device of claim 3, wherein the fluid passages of the first body are radially aligned from a center of the second body.

6. The injection device of claim 1, wherein the second material is permeable to the fluid.

7. The injection device of claim 6, wherein the second material comprises a pressed material.

8. The injection device of claim 1, wherein the geometry includes a controlled direction and opening size.

9. The injection device of claim 1, wherein the first material comprises a castable material.

* * * * *